US006177855B1

(12) United States Patent
Bouillot et al.

(10) Patent No.: US 6,177,855 B1
(45) **Date of Patent: *Jan. 23, 2001**

(54) TRANSFORMERS HAVING CLOSED FERRITE MAGNETIC CIRCUITS

(75) Inventors: Jean-Michel Bouillot, Velay; David Escudero, Chenove, both of (FR)

(73) Assignee: Thomson Television Components France, Auxonne (FR)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/856,069

(22) Filed: May 14, 1997

Related U.S. Application Data

(63) Continuation of application No. 08/362,650, filed on Dec. 21, 1994, now abandoned.

(30) Foreign Application Priority Data

Dec. 21, 1993 (FR) ..... 93 15361

(51) Int. Cl.[7] ..... H01F 17/06; H01F 27/00; H01F 21/08

(52) U.S. Cl. ..... 336/178; 336/100; 336/165; 336/212

(58) Field of Search ..... 336/178, 212, 336/165, 219, 100

(56) References Cited

U.S. PATENT DOCUMENTS

| | | | | |
|---|---|---|---|---|
| 2,379,664 | * | 7/1945 | Stanko | 336/178 |
| 2,494,180 | * | 1/1950 | Koubek | 336/178 |
| 3,316,515 | * | 4/1967 | Bock et al. | 330/219 |
| 5,025,241 | | 6/1991 | Bouillot et al. | 336/100 |

FOREIGN PATENT DOCUMENTS

| | | |
|---|---|---|
| 1 245 487 | 5/1964 | (DE) . |
| 36 11 906 | 10/1987 | (DE) . |
| 0 390 643 | 10/1990 | (EP) . |

* cited by examiner

*Primary Examiner*—Michael L. Gellner
*Assistant Examiner*—Anh Mai
(74) *Attorney, Agent, or Firm*—Joseph S. Tripoli; Joseph J. Laks; Daniel E. Sragow

(57) ABSTRACT

A transformer, comprising: a closed ferrite magnetic circuit having an air gap; a rigid component filling a portion of the air gap; and, a flexible material filling the remainder of the air gap to substantially absorb vibrations of the ferrite. In the case of air gaps greater than approximately 1 mm, the flexible material fills approximately 1 mm of the air gap and the rigid component fills the remainder of the air gap. The rigid component may be of non magnetic, synthetic resin material. The flexible material may be a one component mastic, for example polysulfur, polysulfate polysulphide or polyurethane. The flexible material may also be a silicone type mastic, for example a neutral silicone.

5 Claims, 1 Drawing Sheet

FIG.1
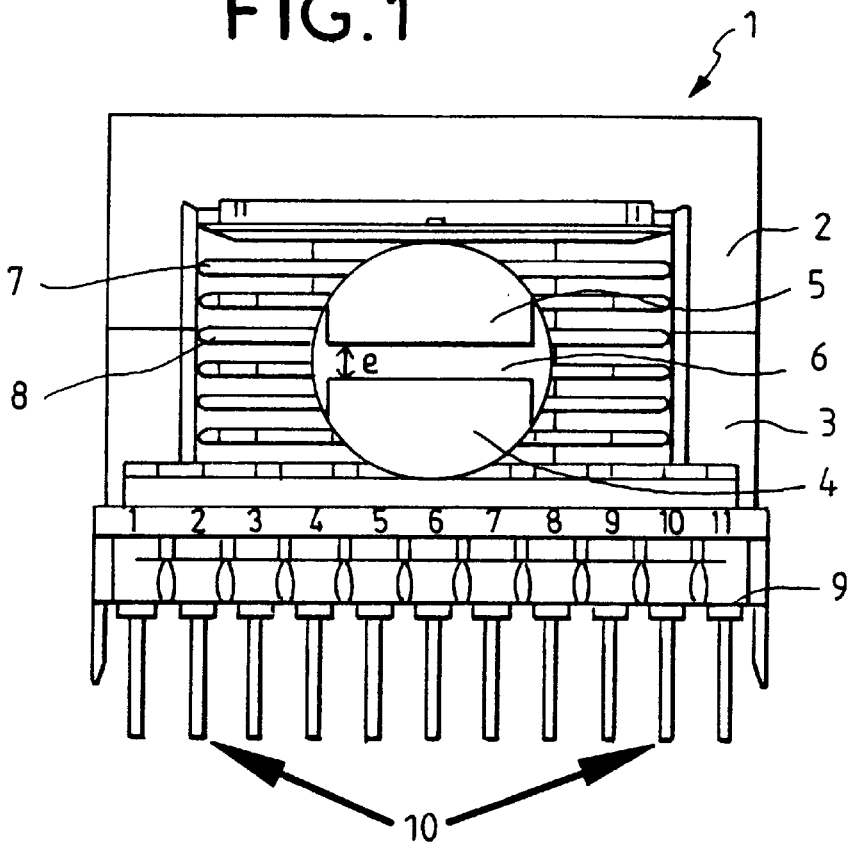
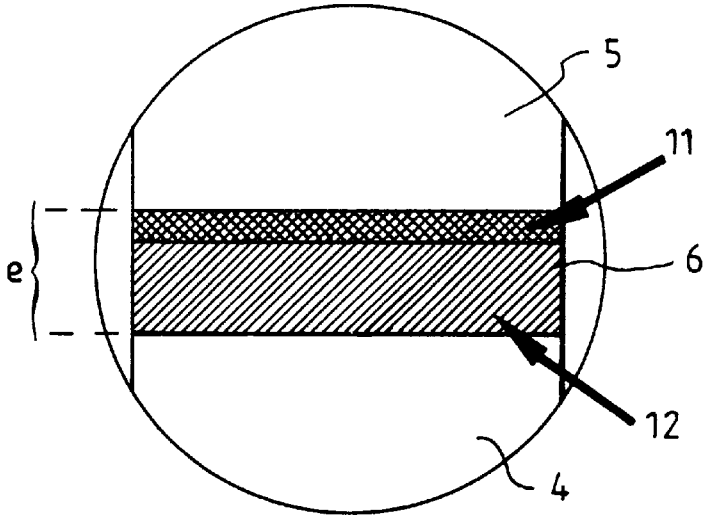
FIG.2

TRANSFORMERS HAVING CLOSED FERRITE MAGNETIC CIRCUITS

This is a continuation of application Ser. No. 08/362,650, filed on Dec. 21, 1994 now abandoned.

BACKGROUND OF THE INVENTION

1. Field of the Invention

The invention relates to the field of transformers having closed ferrite magnetic circuits with an air gap, and in particular, to arrangements for reducing magnetostrictive vibrations by filling the air gap.

2. Description of Related Art

Transformers having closed ferrite magnetic circuits with an air gap are used notably in switching power supplies. The reason is that such power supplies operate in accumulation mode or "fly-back" mode requiring storage of energy in the ferrite magnetic circuit of a transformer before transferring this energy to the electrical circuit fed by the transformer. This energy storage necessitates the use of a magnetic circuit having an air gap. Traditionally, a transformer used in a switching power supply comprises a magnetic circuit consisting of two ferrite half-circuits whose section is "E-shaped", and a frame consisting of one or more electrically insulated coils. This frame has an axial hole which receives the central "leg" of the "E". The magnetic circuit and the frame are assembled by gluing. Preferably, one of the ferrite half circuits is glued to the frame, then the two half-circuits are assembled by gluing together the ends of their outer legs. This arrangement leaves an air gap between the inner legs and guarantees good mechanical strength for the magnetic circuit and the coils, since the air gap easily absorbs mechanical stresses, notably those due to thermal shocks according to current standards. However, in the presence of an air gap, magnetostrictive phenomena cause audible buzzing of the transformer. This magnetostrictive is a deformation effect related to the magnetization cycle. The geometry of the ferrite varies with the magnetic induction.

Suggestions for correcting this problem include filling the air gap with various types of flexible material in order to absorb the magnetostrictive vibrations caused by the opposing faces of the ferrite material defining the air gap in the magnetic circuit.

German application DE AS 1 245 487 suggests that air gaps or layers of non magnetic material be filled with a strongly adhesive hardenable material, particularly a thixotropic hardenable epoxy or polyurethane resin. Alternatively, a mechanical damping layer formed from a glass fabric impregnated with a flexible lacquer is suggested.

German application DE OS 36 11 906 suggests filling an air gap with an epoxy resin of a particular composition. A ceramic platelet is embedded in the resin. The entire filler mass is said to have a coefficient of thermal expansion adapted to that of ferrite.

French patent application FR. 87 15207, in the name of the company Orega Electronique et Mecanique, and corresponding to EP 0 390 643 and U.S. Pat. No. 5,025,241, proposes filling the gap with a silicone-type material. In order to assure the shock absorbing effect in a transformer working at variable frequencies, a one component mastic material filling the gap should have a Shore hardness that is stable with temperature, for example a polysulfphide or polyurethane mastic.

Although these materials produce good results when the gap is narrow, defined herein as being less than approximately 1 mm, such materials are less effective for larger gaps, because they must be soft enough to absorb vibrations, yet hard enough to limit the amplitude of these vibrations. None of the materials noted provides adequate characteristics in the case of large gaps.

SUMMARY OF THE INVENTION

The object of the invention is to overcome this problem by proposing a new type of gap filler.

In accordance with this object, a transformer of the closed ferrite magnetic circuit type includes an air gap partially filled with a material sufficiently flexible to absorb vibrations, wherein a rigid component is also inserted in the air gap.

The rigid component may substantially fill the air gap or fill it only partially. The height of the rigid component should preferably be approximately 0.1 mm less than the gap. The remaining space is filled with flexible material. In accordance with an inventive arrangement, the rigid component is made of non magnetic material which displays no deformation at the operating temperatures of the transformer, that is temperatures up to approximately 110° C. This non-magnetic material is preferably a "bakelite" type synthetic resin.

A transformer in accordance with an inventive arrangement comprises: a closed ferrite magnetic circuit having an air gap; a rigid component filling a portion of the air gap; and, a flexible material filling the remainder of the air gap to substantially absorb vibrations of the ferrite. In the case of air gaps greater than approximately 1 mm, the flexible material fills approximately 1 mm of the air gap and the rigid component fills the remainder of the air gap. The rigid component may be of non magnetic, synthetic resin material. The flexible material may be a one component mastic, for example polysulfur, polysulfate or polyurethane. The flexible material may also be a silicone type mastic, for example a neutral silicone.

BRIEF DESCRIPTION OF THE DRAWINGS

FIG. 1 is a sectional view of a transformer with a "double-E" magnetic circuit according to one embodiment of the invention.

FIG. 2 is an enlarged sectional view of the gap of the transformer in FIG. 1, filled with a sufficiently flexible material and a rigid component according to an inventive arrangement.

DETAILED DESCRIPTION OF THE PREFERRED EMBODIMENTS

In FIG. 1 a transformer 1 used in a switching power supply includes a magnetic circuit comprising two ferrite half-circuits 2 and 3, whose section is E-shaped. The lower half-circuit 3 has an inner leg 4 that is shorter than the two outer legs, whereas the upper half-circuit 2 has an inner leg 5 of the same length as the two outer legs. Thus, when the two half-circuits are assembled an air gap 6 of width e is formed between the inner legs 4 and 5.

In addition, the transformer includes a frame 7 carrying a winding 8 comprising one or more coils electrically insulated from each other. The magnetic circuit and frame are assembled by gluing using known techniques. Similarly, the two half-circuits 2 and 3 are solidly assembled by gluing together the ends of the outer legs. The lower half-circuit 3 is attached using known techniques to the transformer base 9 used for mounting the transformer and providing the electrical contacts to the coils via a series of pins 10.

According to an inventive arrangement, and as shown in detail in FIG. 2, the gap 6 between the inner legs 4 and 5 of the half-circuits is filled with material intended to significantly reduce the noise caused by magnetostrictive phenomena. According to the invention, this sound absorbing material comprises a first material 11 sufficiently flexible to absorb vibrations, which could be either a one-component mastic or a silicone-type material. The one-component mastic has a Shore hardness of about 3 ShA that is stable over an operating range of temperatures for the transformer, for example from approximately 25° C. to approximately 110° C. This mastic may be a polysulfur or polyurethane mastic. Polysulfur mastics, for example polysulfates and polysulphides, are preferable since these are more flexible than the polyurethanes. Silicone-type mastics, for example neutral silicones, can also be used.

A rigid filler component is positioned beneath this flexible material located under the inner leg 5. This rigid component is made from a non-magnetic material, such as the "bakelite"-type synthetic resins. The resin must be able to withstand temperatures of approximately 110° C. without deforming. This rigid component, which functions as a mechanical shock absorber, may substantially fill the gap or fill it only partially. This type of rigid filler component is particularly advantageous for gaps exceeding 1 mm. In such cases, the noise caused by magnetostrictive phenomena and pole-piece vibrations are significantly reduced. To obtain maximum effectiveness, the rigid component should fill most of the gap, only about 0.1 mm being filled with flexible mastic.

We shall now describe in more detail the fitting into the gap 6 of the filler assembly comprising the rigid component and the flexible mastic. First a drop of glue is applied to the end of the inner leg, for example 4, of one of the ferrite half-circuits. This glue enables the rigid component, for example bakelite, to be immobilized mechanically. Next the half-circuit 3, with the bakelite component 12 in place, is positioned in the frame. Finally, using known techniques, a quantity of mastic 11 is deposited on the component 12 before closing the magnetic circuit by positioning the ferrite half-circuit 2.

What is claimed is:

1. A transformer comprising a closed ferrite magnetic circuit formed of a first half circuit and a second half circuit, the first half circuit and the second half circuit having respectively a first leg and a second leg for forming an air gap between said first leg and said second leg, a rigid component formed of a non-magnetic material being mechanically immobilized with respect to said first leg, said rigid component filling a portion of said air gap, and a flexible vibration absorbing material filling a remainder of said air gap and forming a continuous layer covering the end surface of the second leg.

2. A transformer according to claim 1, wherein said air gap is more than one millimeter long.

3. A transformer according to claim 1, wherein said transformer is usable in a switched mode power supply.

4. A transformer comprising a closed ferrite magnetic circuit formed of a first half circuit and a second half circuit, the first half circuit and the second half circuit having respectively a first leg and a second leg for forming an air gap between said first leg and said second leg, a rigid component formed of a non-magnetic material being mechanically immobilized with respect to said first leg, said rigid component filling a portion of said air gap, a flexible vibration absorbing material filling a remainder of said air gap and forming a continuous layer covering the end surface of the second leg, said remainder being less than 1/10 of said gap long.

5. A transformer comprising a closed ferrite magnetic circuit formed of a first half circuit and a second half circuit, the first half circuit and the second half circuit having respectively a first leg and a second leg for forming an air gap between said first leg and said second leg, a rigid component formed of a non-magnetic material being mechanically immobilized with respect to said first leg, and a flexible vibration absorbing material filling the portion of the air gap between said second leg and the rigid component, and forming a continuous layer covering the end surface of the second leg.

* * * * *